US009125451B2

(12) United States Patent
Pham

(10) Patent No.: US 9,125,451 B2
(45) Date of Patent: Sep. 8, 2015

(54) ORTHOPEDIC SANDAL FOR PREVENTION OF PLURALITY OF HEALTH PROBLEMS IN FOOT, ANKLE, AND SPINE

(71) Applicant: Loan Kim Thi Pham, Hcmc (VN)

(72) Inventor: Loan Kim Thi Pham, Hcmc (VN)

( * ) Notice: Subject to any disclaimer, the term of this patent is extended or adjusted under 35 U.S.C. 154(b) by 522 days.

(21) Appl. No.: 13/641,700

(22) PCT Filed: Oct. 16, 2012

(86) PCT No.: PCT/IB2012/055616

§ 371 (c)(1),
(2) Date: Oct. 17, 2012

(87) PCT Pub. No.: WO2014/060794

PCT Pub. Date: Apr. 24, 2014

(65) Prior Publication Data

US 2014/0101969 A1 Apr. 17, 2014

(51) Int. Cl.

| | |
|---|---|
| ***A43B 3/12*** | (2006.01) |
| ***A43B 7/14*** | (2006.01) |
| ***A43B 13/20*** | (2006.01) |
| ***A43B 1/10*** | (2006.01) |
| ***A43B 13/12*** | (2006.01) |
| ***A43B 13/18*** | (2006.01) |
| ***A43B 13/40*** | (2006.01) |
| ***A43B 13/42*** | (2006.01) |
| ***A63B 3/00*** | (2006.01) |

(52) U.S. Cl.

CPC ... *A43B 7/14* (2013.01); *A43B 1/10* (2013.01); *A43B 3/122* (2013.01); *A43B 3/126* (2013.01); *A43B 3/128* (2013.01); *A43B 7/147* (2013.01); *A43B 13/122* (2013.01); *A43B 13/181* (2013.01); *A43B 13/189* (2013.01); *A43B 13/20* (2013.01); *A43B 13/40* (2013.01); *A43B 13/42* (2013.01); *A63B 3/00* (2013.01)

(58) Field of Classification Search

CPC ..... A43B 3/122; A43B 3/126; A43B 3/128; A43B 13/20; A43B 13/40; A43B 13/42

USPC ..... 36/11.5

See application file for complete search history.

(56) References Cited

U.S. PATENT DOCUMENTS

| | | | | | |
|---|---|---|---|---|---|
| 2,481,281 | A * | 9/1949 | Bender | 36/11.5 |
| 2,588,061 | A * | 3/1952 | Vesely | 36/11.5 |
| 3,968,577 | A * | 7/1976 | Jackson | 36/43 |
| 4,095,353 | A * | 6/1978 | Foldes | 36/11.5 |
| 5,787,608 | A * | 8/1998 | Greenawalt | 36/11.5 |
| 2006/0130363 | A1* | 6/2006 | Hottinger | 36/28 |

* cited by examiner

*Primary Examiner* — Ted Kavanaugh

(57) ABSTRACT

An orthopedic sandal comprises a sole and six mounted straps. Made of rubber that generates high friction, the straps pass through the edge of the sole to create 12 one to three centimeter-long extensions underneath the sole. The 12 extensions generate extra friction when the sandal contacts with the ground. The sole consists of an outer layer and an inner layer. Made of rubber mixed with nylon fibers, the outer layer has an empty inside divided sidewardly into 4 compartments. Each compartment is divided horizontally into two by a thin rubber layer. Made of soft rubber, the inner layer is a pouch divided into three compartments filled with special soft gel that has physical stability under the change of temperature and pressure. The inner layer is pre-shaped to ergonomically fit the wearer's sole and is also able to reshape to well fit the wearer's particular sole.

2 Claims, 5 Drawing Sheets

ORTHOPEDIC SANDAL FOR PREVENTION OF PLURALITY OF HEALTH PROBLEMS IN FOOT, ANKLE, AND SPINE

FIELD OF THE INVENTION

The present invention relates to an orthopedic sandal used for prevention of plurality of health problems in foot, ankle, and spine.

BACKGROUND OF THE INVENTION

Among many types of footwear and foot care products being sold in the market nowadays, there are orthopedic footwear and orthotics that dedicate to providing pain relief and support for foot, ankle, and spine in order to prevent different health problems in those body parts. To be able to deliver such pain relief and support, it requires customization for those orthopedic footwear and orthotics to fit ergonomically into the soles of a particular wearer's foot; however, that customization takes hours to be done. Moreover, normally made of low resilient materials, those orthopedic footwear and orthotics do not absorb the ground reaction force effectively, reducing their ability of preventing health problems. For those orthopedic footwear and orthotics that are mass-produced identically and are not customized, they do not fit into a particular wearer's sole well; therefore they cannot effectively provide pain relief or proper support for foot, ankle, and spine.

U.S. Pat. No. 4,314,412 presents an orthopedic shoe that can be configured to better fit a wearer's sole; however, it cannot fit into a particular wearer's sole as it is not produced particularly for him and as there is no any individual customization provided. U.S. Pat. No. 7,367,074 B1 presents customized molded orthotic shoe insert method and apparatus, which can provide well-fitted shoe inserts. However, this shoe insert needs time to be made. Besides, made of heat malleable synthetic resin material, this shoe insert has low resilience; therefore, it won't absorb the ground reaction force very well, reducing its ability of preventing health problems in foot, ankle, and spine.

SUMMARY OF THE INVENTION

It shows that there is a need to invent a type of orthopedic footwear that not only provides pain relief and support for foot, ankle, and spine by fitting a wearer's sole ergonomically, but also does not require time-consuming customization in order to fit a particular wearer's sole well. This type of orthopedic footwear should be durable under different usage conditions too. By providing the right support for foot, ankle, and spine, this type of orthopedic footwear is able to prevent problems in those body parts, such as foot pronation, foot supination, ankle fracture, disc herniation, lordosis, and kyphosis.

According to the invention, the type of orthopedic footwear is an orthopedic sandal that comprises a sole and mounted straps that secure the sole to a wearer's foot. There are six different straps; four of them hold the front of the foot, and two of them hold the ankle. The straps pass through the edge of the sole to create 12 extensions underneath the sole. Each of the extension is about 1 to 3 centimeters long.

The sole consists of two different layers—an outer layer and an inner layer. The outer layer is made of rubber mixed with nylon fibers. Thanks to the materials used, the outer layer has a number of special features. First, it is able to generate strong friction against the ground, preventing skidding and helping the wearer walk on different terrains safely. Second, it can prevent sharp objects from penetrating through; therefore the sandal is able to keep the wearer's foot safe. Third, it is extremely durable in different usage conditions, such as under water, in a hot desert, or on rocky areas. The outer layer has an empty inside that expands from the front portion of the outer layer that is under the wearer's toes to the end portion of the outer layer that is under the wearer's heel. The empty inside is divided sidewardly by 3 dividers into 4 compartments. In each compartment, there is a thin rubber layer that horizontally divides the compartment into two. With high elasticity, this thin rubber layer absorbs the ground reaction force when the wearer is walking, running, and especially jumping, reducing the force put onto foot, ankle, and spine, thus preventing damages to those body parts.

The inner layer is the one contacting with the wearer's foot. This inner layer is actually a foot-sized pouch made of soft rubber. The pouch is divided into three compartments; the first compartment is under the foot arch, the second compartment is under the empty space under the toes, and the third compartment is the rest of the pouch. The pouch, i.e. all of its compartments, is filled with special soft gel that has physical stability, including the stability of viscosity, under the changes of temperature and pressure, meaning the softness of the inner layer is unchanged under different usage condition such as in cold weather, in a hot desert, or under different weights of different wearers. The inner layer is pre-shaped to ergonomically fit the wearer's sole. However, as it is made of soft rubber and filled with the special soft gel, the inner layer is, under the gravity force of the wearer's body, able to reshape to well fit the wearer's particular sole. This special feature of the inner layer eliminates the need of time-consuming customization for an orthopedic shoe or an orthotic to well fit a wearer's foot. As the inner layer well fits the wearer's foot, it spreads the force put on the wearer's foot more evenly, preventing problems such as foot pronation and foot supination.

The straps are made of rubber that generates high friction; therefore the sandal can hold the wearer's foot securely. The 12 extensions of the straps generate extra friction when the sandal contacts with the ground, further preventing the wearer from skidding. To hold the wearer's foot more securely, the length of the straps' portion that holds the wearer's foot is adjustable by pulling or pushing the 12 extensions of the straps. Besides, the straps are replaceable, making the sandal economical to use over time.

DESCRIPTION OF THE DRAWINGS

The invention will be better understood when consideration is given to the following detailed description thereof. Such description makes reference to the annexed drawings wherein.

DETAILED DESCRIPTION OF THE INVENTION

The present invention provides an orthopedic sandal for prevention of of plurality of health problems in foot, ankle, and spine.

Figure 1:
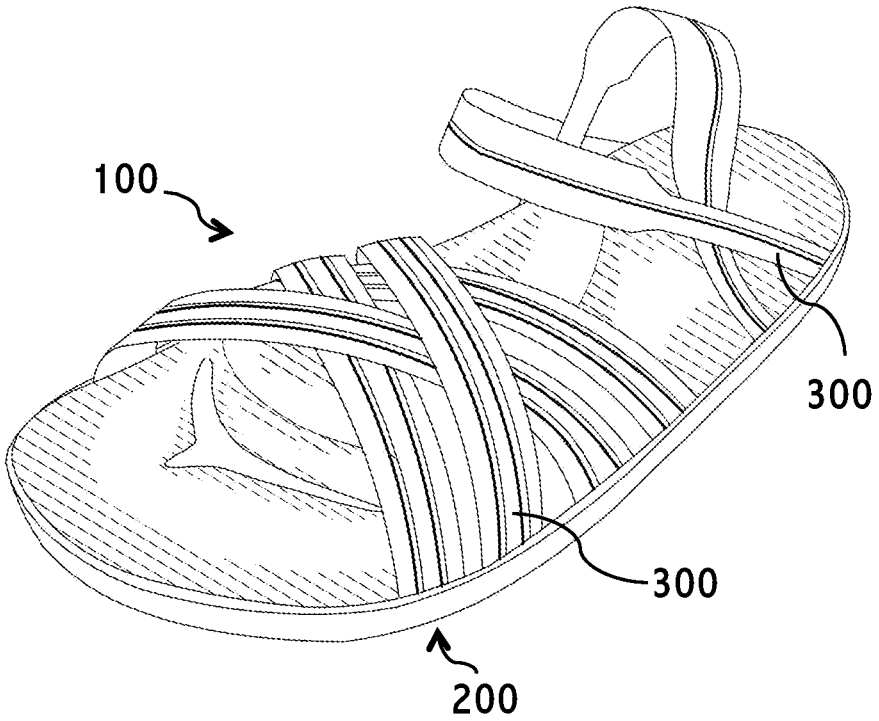
FIG. 1 is a left perspective view of an orthopedic sandal for prevention of plurality of health problems in foot, ankle, and spine according to the invention.
Figure 2:
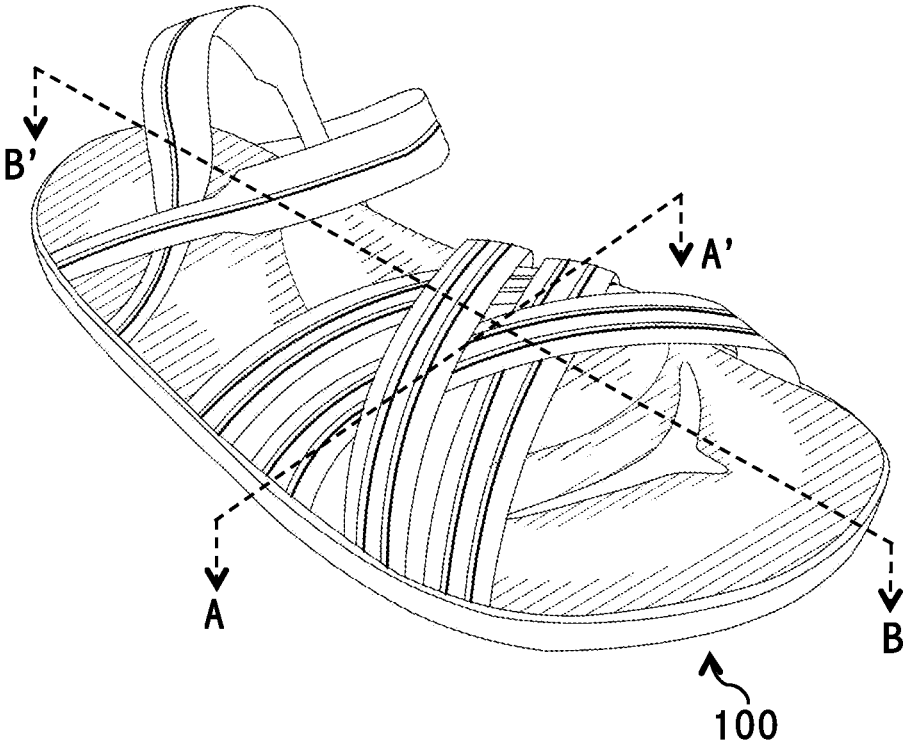
FIG. 2 is a right perspective view of the orthopedic sandal shown in FIG. 1
Figure 3:
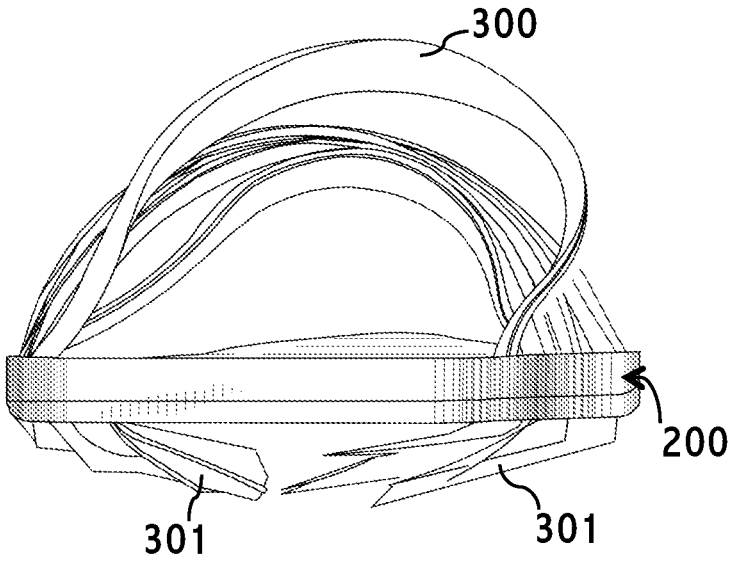
FIG. 3 is a rear view of the orthopedic sandal shown in FIG. 1
Figure 4:
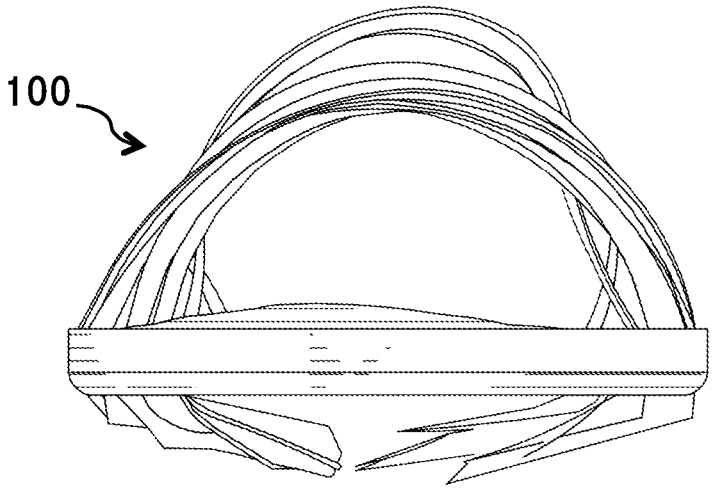
FIG. 4 is a front view of the orthopedic sandal shown in FIG. 1
Figure 5:
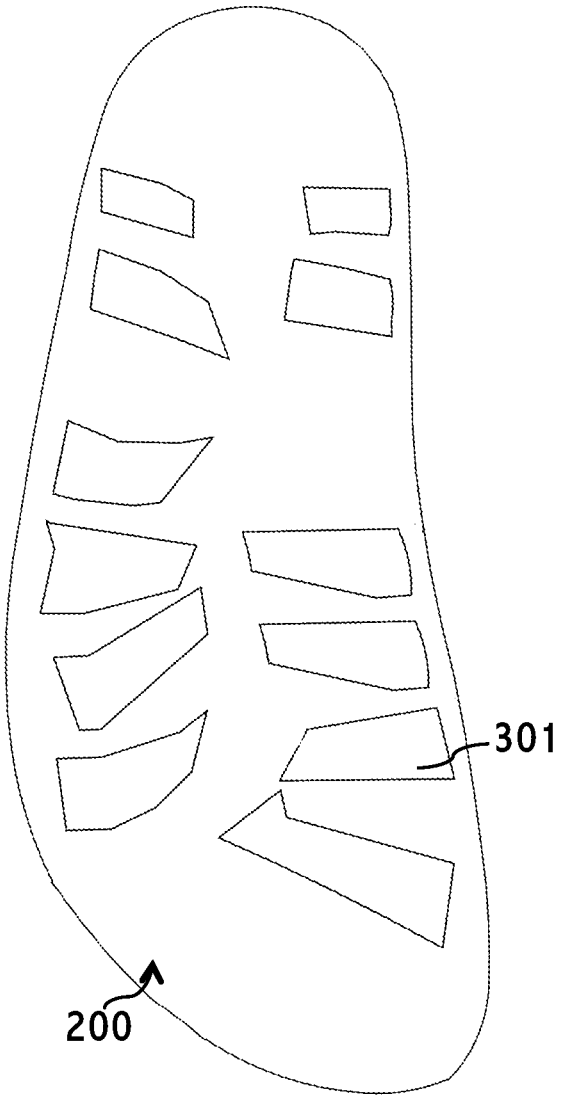
FIG. 5 is a bottom view of the orthopedic sandal shown in FIG. 1
Figure 6:
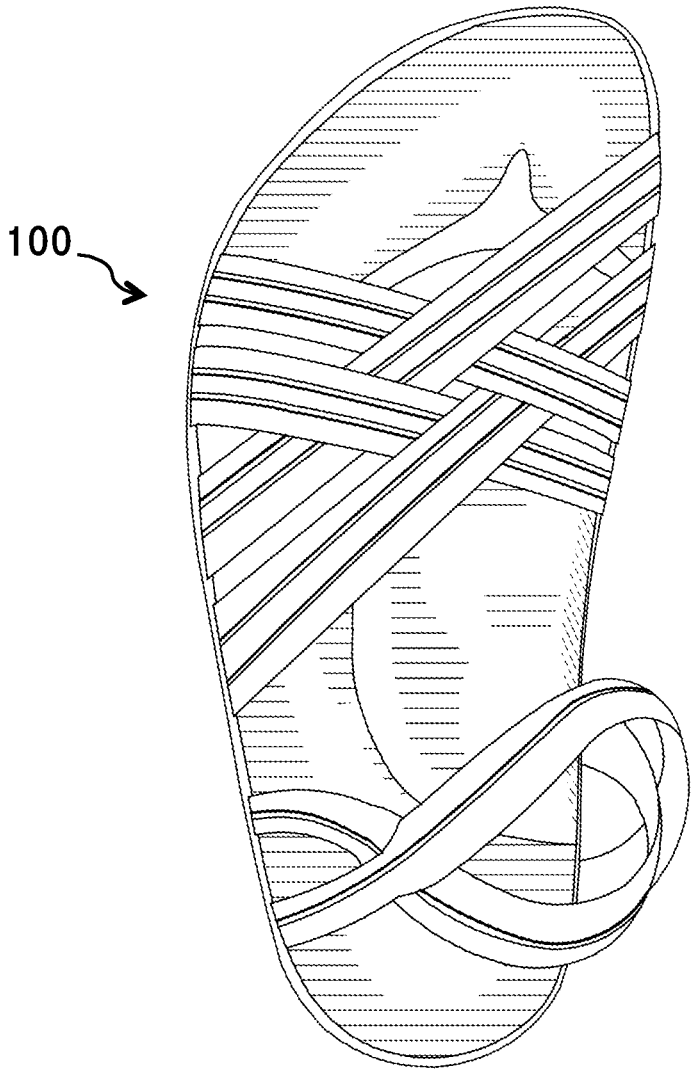
FIG. 6 is a top view of the orthopedic sandal shown in FIG. 1

According to the invention, the orthopedic sandal 100, as shown in FIG. 1, comprises a sole 200 and mounted straps 300 that secure the sole 200 to a wearer's foot. There are six different straps 300; four of them hold the front of the foot, and two of them hold the ankle. The straps pass through the edge of the sole 200 to create 12 extensions 301 underneath the sole, as shown in FIG. 5. Each of the extension 301 is about 1 to 3 centimeters long.

Figure 7:
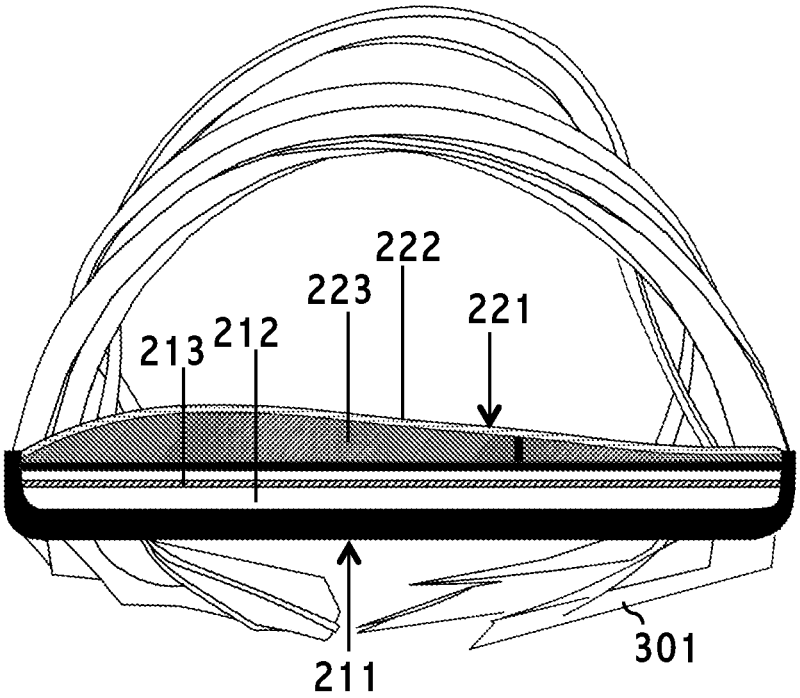
FIG. 7 is a cross-sectional view of the orthopedic sandal of FIG. 1 along the line A-A' shown in FIG. 2
Figure 8:
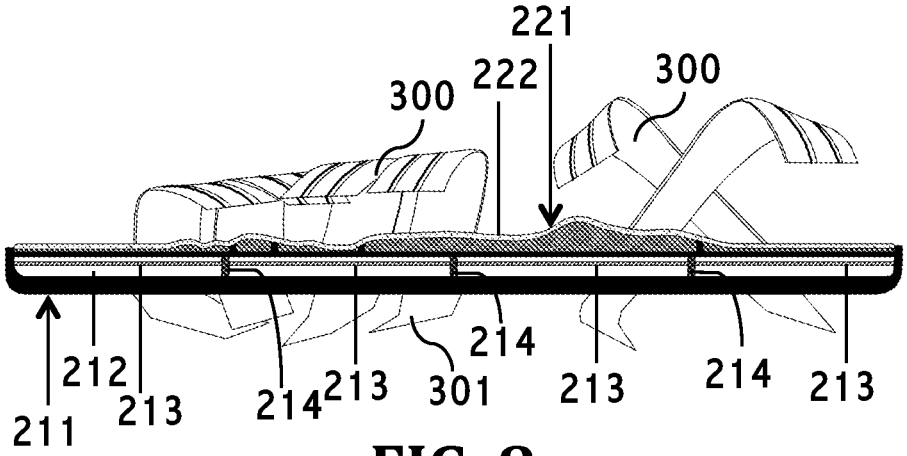
FIG. 8 is a cross-sectional view of the orthopedic sandal of FIG. 1 along the line B-B' shown in FIG. 2

The sole 200 consists of two different layers—an outer layer 211 and an inner layer 221, as shown in FIG. 7 and FIG. 8. The outer layer 211 is made of rubber mixed with nylon fibers. Thanks to the materials used, the outer layer 211 has a number of special features. First, it is able to generate strong friction against the ground, preventing skidding and helping the wearer walk on different terrains safely. Second, it can prevent sharp objects from penetrating through; therefore the sandal is able to keep the wearer's foot safe. Third, it is extremely durable in different usage conditions, such as under water, in a hot desert, or on rocky areas.

The outer layer 211 has an empty inside 212 that expands from the front portion of the outer layer 211 that is under the wearer's toes to the end portion of the outer layer 211 that is under the wearer's heel. The empty inside 212 is divided sidewardly by 3 dividers 214 into 4 compartments. In each compartment, there is a thin rubber layer 213 that horizontally divides the compartment into two. With high elasticity, this thin rubber layer 213 absorbs the ground reaction force when the wearer is walking, running, and especially running, reducing the force put onto foot, ankle, and spine, thus preventing damages to those body parts.

The inner layer 221 is the one contacting with the wearer's foot. This inner layer 221 is actually a foot-sized pouch 222 made of soft rubber. The pouch 222 is divided into three compartments; the first compartment is under the foot arch, the second compartment is under the empty space under the toes, and the third compartment is the rest of the pouch. The pouch 222, i.e. all of its compartments, is filled with special soft gel 223 that has physical stability, including the stability of viscosity, under the changes of temperature and pressure, meaning the softness of the inner layer 221 is unchanged under different usage condition such as in cold weather, in a hot desert, or under different weights of different wearers. The inner layer 221 is pre-shaped to ergonomically fit the wearer's sole. However, as it is made of soft rubber and filled with the special soft gel, the inner layer 221 is, under the gravity force of the wearer's body, able to reshape to well fit the wearer's particular sole. This special feature of the inner layer 221 eliminates the need of time-consuming customization for an orthopedic shoe or an orthotic to well fit a wearer's foot. As the inner layer 211 well fits the wearer's foot, it spreads the force put on the wearer's foot more evenly, preventing problems such as foot pronation and foot supination.

The straps 300 are made of rubber that generates high friction; therefore the sandal 100 can hold the wearer's foot securely. The 12 extensions 301 of the straps 300 generate extra friction when the sandal 100 contacts with the ground to further prevent the wearer from skidding. To hold the wearer's foot more securely, the length of the straps' portion that holds the wearer's foot is adjustable by pulling or pushing the 12 extensions 301 of the straps 300. Besides, the straps 300 are replaceable, making the sandal 100 economical to use over time.

What is claimed is:

1. An orthopedic sandal for prevention of plurality of health problems in foot, ankle, and spine that comprises a sole and mounted straps that secure the sole to a wearer's foot; there are six different said straps, four of them hold a front of the foot, and two of them hold an ankle;

said straps pass through an edge of the said sole to create twelve extensions underneath the sole; each of the extension is about one to three centimeters long;

said straps are made of rubber that generates high friction;

said sole consists of two different layers—an outer layer and an inner layer;

said outer layer is made of rubber mixed with nylon fibers;

said outer layer has an empty inside that expands from a front portion of the outer layer that is under the wearer's toes to an end portion of the outer layer that is under a wearer's heel;

said empty inside is divided sidewardly by three dividers into four compartments;

in each said compartment, there is a thin rubber layer that horizontally divides said compartment into two;

said inner layer is a pouch made of soft rubber that is in contact with the wearer's foot;

said pouch is filled with special soft gel that has physical stability, including stability of viscosity, under a change of temperature and pressure;

said inner layer is pre-shaped to ergonomically fit a wearer's sole;

said inner layer is able to reshape under the gravity force of the wearer's body.

2. The orthopedic sandal set forth in claim 1 whereas the length of said straps' portion that holds the wearer's foot is adjustable by pulling or pushing said strap extensions.

* * * * *